United States Patent [19]

Dell'Orto

[11] 4,411,225

[45] Oct. 25, 1983

[54] OIL PUMP FOR INTERNAL COMBUSTION ENGINES

[75] Inventor: Pierluigi Dell'Orto, Milan, Italy

[73] Assignee: Dell'Orto S.p.A., Milan, Italy

[21] Appl. No.: 364,648

[22] Filed: Apr. 2, 1982

[30] Foreign Application Priority Data

Apr. 7, 1981 [IT] Italy ..... 20966 A/81

[51] Int. Cl.[3] ..... F01M 3/02; F01M 1/00

[52] U.S. Cl. ..... 123/73 AD; 123/196 R

[58] Field of Search ..... 123/73 AD, 196 R

[56] References Cited

U.S. PATENT DOCUMENTS 3,114,356 12/1963 Werner et al. ..... 123/73 AD
3,137,285 6/1967 Ausserbauer ..... 123/73 AD X
3,202,102 8/1965 Staege et al. ..... 123/73 AD
3,929,110 12/1975 Raikov et al. ..... 123/73 AD
4,114,587 9/1978 Amano et al. ..... 123/73 AD

FOREIGN PATENT DOCUMENTS 3025002 2/1981 Fed. Rep. of Germany 123/73 AD AD

*Primary Examiner*—Wendell E. Burns
*Attorney, Agent, or Firm*—Burns, Doane, Swecker & Mathis

[57] ABSTRACT

An oil pump for two-stroke internal combustion engines fed from separate fuel and oil tanks, apt to form an oil flow varying according to the number of engine revolutions and according to the opening of the carburettor throttle valve.

The pump comprises a rotary oil distributor with three axial pumping cylinders, the strokes of the cylinder pistons being adjusted by a cam oscillating in response to the opening of the carburettor throttle valve.

5 Claims, 4 Drawing Figures

OIL PUMP FOR INTERNAL COMBUSTION ENGINES

BACKGROUND OF THE INVENTION

The invention relates to an oil pump for internal combustion engines and especially two-stroke engines intended to equip motorcycles.

It is well known to the technicians skilled in the art that two-stroke engines are fed with an appropriate mixture of petrol and oil, the oil-to-petrol ratio of which varies depending on the characteristics must be used for the mixture.

Where petrol-and-oil ("petroil") pumps exist, no special problems are encountered by the user, who should only remember which mixture ratio (usually 2 to 5 percent) his engine requires.

Where petroil pumps are not available, the fuel tank must be filled up—whenever refuelling is desirable—with an amount of oil proportional to the amount of petrol pumped in, so that the oil-to-petrol ratio required for the engine can be reproduced at all times. This evidently creates notable inconveniences to the user.

Another drawback which anyhow occurs when feeding a two-stroke engine by putting the mixture directly into the fuel tank arises from the fact that, in this case, from the slow running condition up to peak r.p.m., the engine still takes up a mixture with a fixed oil-to-petrol ratio.

It is known, however, that a two-stroke engine requires—for proper performance—a low-content oil mixture, when running at low speeds and using less power, and a higher-content oil mixture when higher speeds are involved and more horsepower is required.

The ideal solution is thus to equip the engine, for instance of a motorcycle, with two separate tanks, one for petrol and the other for lubricating oil, and with a device supplying the optimum amount of oil in the oil-and-petrol mixture for each running condition of the engine.

Such device is the oil pump for two-stroke engines. This is already known in various practical accomplishments, wherein it supplies a variable oil flow—according to the piston displacement of the engine being fed—either in function of two parameters, being the engine revolutions and the carburettor throttle valve opening, or in function of only the first of said two parameters.

In fact, while in very small two-stroke engines for motor-bicycles, oil consumption is very low and an adequate performance can still be obtained through the simplified system which controls the lubricating oil flow only in proportion to the engine revolutions, in engines with higher piston displacement—as those for motorcycles—the lubricating oil consumption becomes more considerable and the requirements for a proper performance, even with reduced power, become more demanding. It will thus be necessary to proportion the amount of oil delivered by the pump, not only to the engine speed, but also to the higher or lower degree of chocking of the carburettor throttle valve.

SUMMARY OF THE INVENTION

The present invention relates to an improved oil pump, of the more sophisticated type, apt to be particularly used on engines for motorcycles. Said oil pump comprises a distributing body, which is caused to rotate by a worm-and-wheel mechanism and which houses one or more cylinders positioned parallel to the axis of said rotary body at a short distance therefrom, within each of which cylinders a cam-controlled piston can be displaced against the action of return-spring means, and is characterized in that the said distributing body coincides with the wheel of the worm-and-wheel mechanism and does not have a true and proper rotation axle, in that the said cylinders are fed and discharged at their ends facing the front surface of the distributing body, and in that the cam controlling the pistons of said cylinders is in the form of an inclined plane, the inclination of which can be varied under the control of means acting in response to the opening of the carburettor throttle valve of the engine to which the pump is applied.

Preferably, the cam in the form of an inclined plane consists of a substantially rectangular flat block, pivoted at one side and stressed by said means on the opposite side; said means are in the form of a cam obtained at the end of a shaft, the rotation of which is controlled by the members controlling the carburettor throttle valve.

BRIEF DESCRIPTION OF THE DRAWINGS

The invention will now be described in further detail, by mere way of example, with reference to the accompanying drawings which show a preferred embodiment of the pump according to the invention and in which.

DESCRIPTION OF THE PREFERRED EMBODIMENTS

Figure 1:
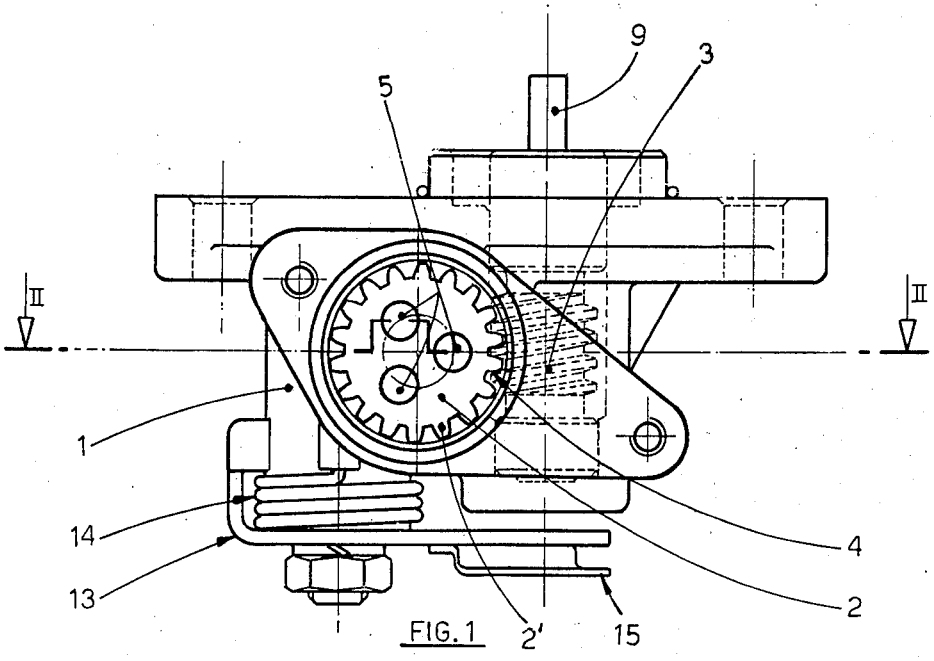
FIG. 1 is a top view of the pump according to the invention, without its cover.

With reference to the drawings, the pump according to the invention comprises a casing 1, into which are obtained a vertical cylindrical seat for a distributing body 2 and a horizontal cylindrical seat for a worm screw 3, which are mutually intersecting.

The distributing body 2 is a simple spur gear, the teeth of which mesh at 4 with the worm screw 3, and which comprises three equally spaced cylindrical holes 5, each with its axis parallel to that of the distributing body but at a short distance therefrom. Each cylinder 5 houses a piston 6, which is normally thrust towards the bottom of the seat for the body 2 by a spring 7, against a cam 8. Said spring 7 is housed in a widening 5' of said cylinder 5, while the cam 8 is adjustably mounted within the bottom of the seat for the body 2.

The distributor 2, in the form of a simple spur gear, has no axle and is freely housed in its seat, wherein it rotates. Thus, the rotation of the distributor 2 within its seat does not take place around a true and proper rotation axle but is merely guided by the precise coupling, with proper tolerance, of the suitably rounded periphery of its teeth 2' with the wall of the cylindrical cavity forming said seat.

The worm screw 3 is housed in its own seat and projects therefrom with a prismatic element 9, through which it is possible to impart a rotation to the worm screw 3 and, thus, to the distributing body or spur gear 2.

Figure 2:
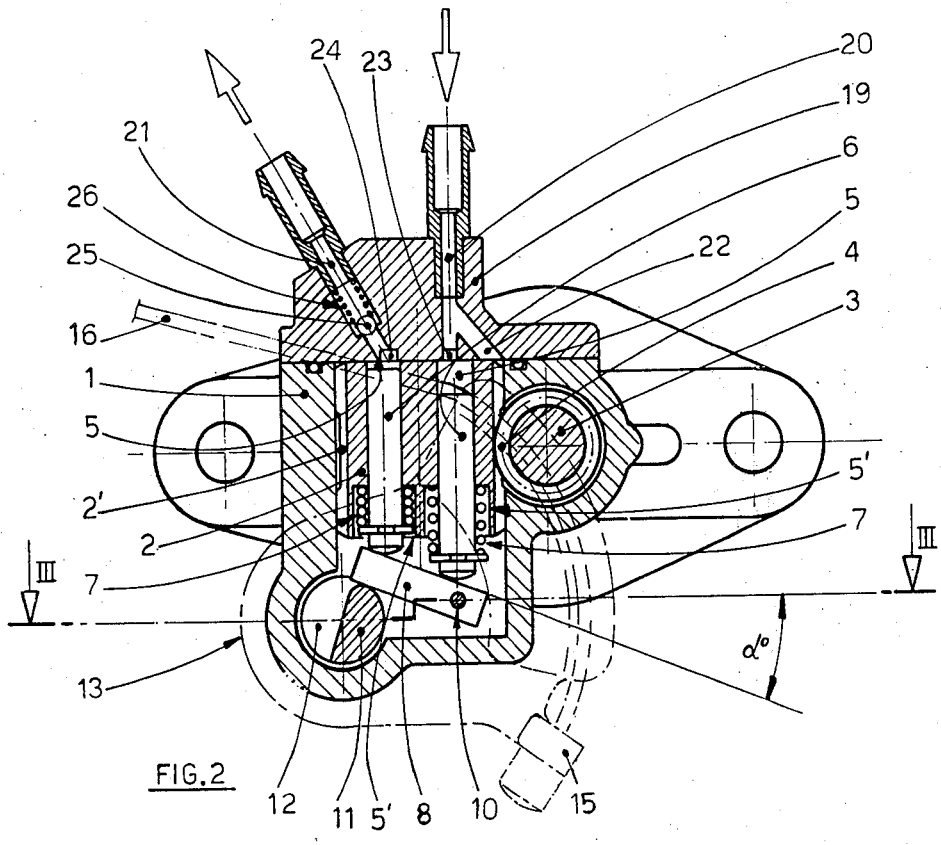
FIG. 2 is a main vertical section view, along the line II—II of FIG. 1, of the pump according to the invention.
Figure 3:
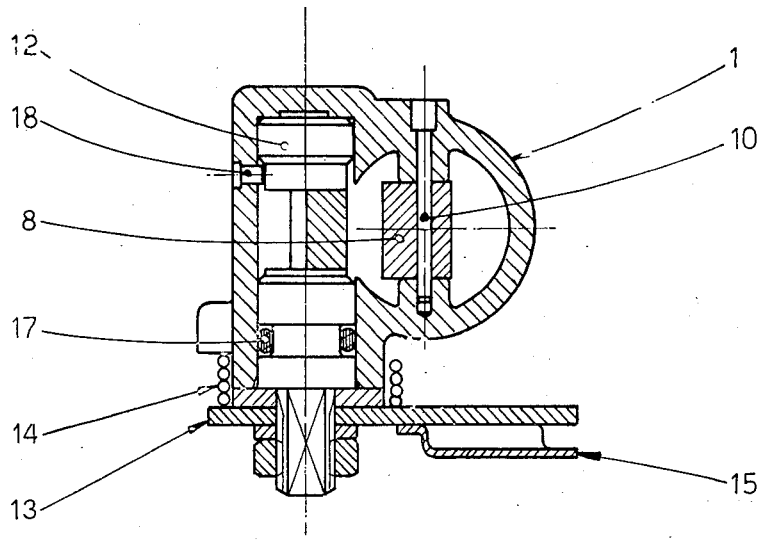
FIG. 3 is a horizontal section view, along the line III—III of FIG. 2, of the pump of FIGS. 1 and 2.

The adjustable cam 8 consists of a flat block of rectangular shape, pivoted at one side on a pin 10 which crosses the bottom of the casing 1, and resting with its lower surface, near the opposite side, against a cam 11 carried by a shaft 12 rotatable about its own axis and controlled by the sector lever 13 which is returned by the helical spring 14 (FIG. 3) and operated at its end 15 by a cable 16 (FIG. 2), connected to the throttle valve control means or like mechanism controlling the engine power (not shown).

The shaft 12 is provided with a sealing ring 17 (FIG. 3), fitted into a groove of said shaft and preventing oil leakage from the pump.

In correspondence of a second groove of the shaft 12 there is mounted a pin 18, which prevents the shaft 12 from sliding out of the casing 1.

The block 8 is constantly held with its bottom surface in close contact with the cam 11, thanks to the action of the pistons 6 of the cylinders 5 which press against the upper surface of said block owing to the springs 7.

The pump is completed by a cover 19, which closes the casing 1 and against the flat inside wall of which bears, tightly mating therewith, the equally flat front surface of the distributing body 2, under the thrust of the springs 7.

The cover 19 is crossed by a feed pipe 20 of the oil to be pumped, by a delivery pipe 21 of the pumped oil, and by a duct 22, branching off from the pipe 20, which ends at the periphery of the seat for the body 2.

In use, the worm screw 3 causes the rotation of the distributing body 2 in its own seat which is flooded, through the duct 22, with the oil to be pumped (which also fills the housing of the worm 3, thus keeping all the elements of the mechanism in an oil bath), thereby generating the pumping action. In fact, along with the distributing body 2, the cylinder 5-piston 6 units rotate as well, the pistons 6 being thrust downwards by the springs 7, when the corresponding cylinder 5 is in communication with the oil feed pipe 20 in order to suck the oil into the upper part of the cylinder 5. From here the oil is sent to the delivery pipe 21 when—the said cylinder 5 finding itself in correspondence of such pipe—the cam 8 pushes upwards the corresponding piston 6.

On the inside surface of the pump cover 19, the pipes 20 and 21 open into slits 23 and 24, suitably designed to match the suction or delivery phases of the pistons 6, and an automatic valve comprising a ball 25 and a spring 26, and located in the delivery pipe 21, prevents oil leakage even when the engine remains idle over long periods of time.

When the engine and the pump according to the invention are running, each position of the cable 16 and, consequently, of the lever 13, of the shaft 12, of the cam 11, and of the upper surface of the oscillating block 8, corresponds to a position of the carburettor throttle valve control means.

On the other hand, to each angular position of said upper surface there corresponds a different working stroke of the pistons 6 and thus, for an equal number of engine revolutions, different flows of lubricating oil delivered to the engine.

At maximum throttle opening, the oil flow delivered will have to be adequate to lubricate the engine at peak load: thus, all the pump elements, and particularly the cam 11 and the diameters and number of pumping cylinders 5, will have to be so proportioned as to allow the oil flow delivery to be exactly as required for lubricating the engine at peak load.

Always at maximum throttle opening, the oscillating block 8 will have reached its highest inclination, whereby each pumping piston 6 will be subject to its maximum pumping stroke, between its bottom dead center position and its top dead center position.

If the highest inclination of the cam 8 is of $\alpha$ degrees and the diameter of the circumference covered by the axes of pistons 6 equals C, it can be easily gathered that the pumping stroke of each piston will be $$H = C \sin \alpha$$

and, if the number of the pistons is N and the radius of their circular section equals R, the theoretical oil flow delivered at each turn of the rotary distributor will be $$Q = \alpha R^2 H N$$

As the throttle gradually closes, the cam 11 moves down due to rotation of the shaft 12 and causes the desired reduction of the flow Q of oil being pumped, reducing the working stroke of pistons 6 within cylinders 5.

Figure 4:
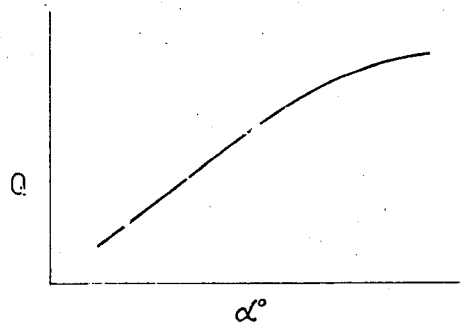
FIG. 4 is a diagram of the oil flow delivered by the pump in one rotation, in function of the angular position of the cam acting on the block forming the inclined plane on which the pistons of the distributing body are resting.

FIG. 4 shows a possible curve of variation of the flow Q in function of the rotation angle $\alpha$ of the shaft 12, i.e. very roughly, in function of the degree of chocking of the throttle valve.

Since the chocking law for a throttle valve is of the aerodynamic type, whereas the chocking law of an oil pump is of the volumetric type, the curve of FIG. 4 will not be on a straight line but curving upward.

It is understood that, during planning, the shape of the cam 11 will have to be properly defined, according to the geometry of the connections between the throttle valve and the shaft 12 and also taking into account the specific requirements of each engine.

Possibly, the curve in FIG. 4 may be corrected by modifying, i.e. curving, the upper and lower surfaces of the block 8, again with the final object of adjusting the most appropriate oil flows to each position of the engine throttle valve.

The pumping cylinder 5-piston 6 units, shown to be three in the drawings, may obviously also be in a different number. Likewise, any other operating details of the pump according to the invention may differ from those heretofore described, without thereby departing from the scope of the invention itself.

I claim:

1. An oil pump for two-stroke internal combustion engines, intended to feed such engines from separate fuel and oil tanks, of the type comprising a distributing body, which is caused to rotate by a worm-and-wheel mechanism and which houses one or more cylinders positioned parallel to the axis of the body itself at a short distance therefrom, within each of which cylinders a cam-controlled piston can be displaced against the action of return-spring means, characterized in that the said distributing body coincides with the wheel of the worm-and-wheel mechanism and does not have a true and proper rotation axle, in that the said cylinders are fed and discharged at their ends facing the front surface of the distributing body, and in that the cam controlling the pistons of said cylinders is in the form of an inclined plane, the inclination of which can be varied under the control of means acting in response to the opening of the carburettor throttle valve of the engine to which the pump is applied.

2. An oil pump as in claim 1, wherein the cam in the form of an inclined plane consists of a substantially rectangular block, pivoted at one side and stressed by said means on the opposite side.

3. An oil pump as in claims 1 or 2, wherein said means for stressing the cam-block and for varying the inclination thereof are themselves in the form of a cam obtained at the end of a shaft, the rotation of which is controlled by the members controlling the carburettor throttle valve or by other means controlling the engine power.

4. An oil pump as in claims 1 to 3, wherein said block has flat surfaces.

5. An oil pump as in claims 1 to 3, wherein said block has curved surfaces.

* * * * *